United States Patent [19]

Stutzman

[11] 4,033,707

[45] July 5, 1977

[54] REFRIGERATION COMPRESSOR STRUCTURES AND THEIR METHODS OF CONSTRUCTION

[75] Inventor: Howard A. Stutzman, Fort Worth, Tex.

[73] Assignee: Atlas Industries, Inc., Woodville, Ohio

[22] Filed: Aug. 18, 1975

[21] Appl. No.: 605,463

Related U.S. Application Data

[62] Division of Ser. No. 347,847, April 4, 1973, abandoned.

[52] U.S. Cl. ..... 417/312; 417/371; 417/419; 417/540; 417/902

[51] Int. Cl.² ..... F04B 21/00

[58] Field of Search ..... 417/366, 416, 419, 312, 417/313, 371, 902, 562, 563, 564, 540–542; 181/36 R

[56] References Cited

UNITED STATES PATENTS

| | | | |
|---|---|---|---|
| 2,055,296 | 9/1936 | Lane | 417/179 X |
| 2,935,248 | 5/1960 | Gertéis | 417/564 |
| 3,073,515 | 1/1963 | Neubauer et al. | 417/419 X |
| 3,175,758 | 3/1965 | Dirk | 417/366 X |
| 3,239,132 | 3/1966 | Frank et al. | 417/371 |
| 3,403,847 | 10/1968 | Parker | 417/564 X |
| 3,671,147 | 6/1972 | Laucks et al. | 417/371 X |
| 3,698,840 | 10/1972 | Hover | 417/312 |
| 3,817,661 | 6/1974 | Ingalls et al. | 417/312 |

*Primary Examiner*—William L. Freeh
*Assistant Examiner*—Edward Look
*Attorney, Agent, or Firm*—David H. Wilson

[57] ABSTRACT

A motor driven refrigeration compressor having a cylinder head and base of laminated construction. The laminations are formed from flat sheet stock with apertures which define inlet and outlet ports and passages for refrigerant flow. The base is bell shaped and the enclosed end contains integral inlet ports and passages which direct refrigerant past the motor and into the compressor. The base walls contain integral outlet passages which convey the refrigerant from the compressor to an outlet tube in communication with a condenser. Both the inlet and outlet passages contain noise reducing cavities which decrease the effect of the pulsations inherent in a piston-type compressor.

24 Claims, 14 Drawing Figures

REFRIGERATION COMPRESSOR STRUCTURES AND THEIR METHODS OF CONSTRUCTION

CROSS-REFERENCE TO RELATED APPLICATIONS

This application is a division of U.S. Pat. application Ser. No. 347,847, filed Apr. 4, 1973, now abandoned, entitled "Improvements in Refrigeration Compressor Structures and Their Methods of Construction."

BACKGROUND OF THE INVENTION

1. Field of the Invention

This invention relates to motor driven compressor units of the type utilized in air-conditioning and refrigeration systems. In particular, the present invention relates to a compressor cylinder head and base of laminated construction with integral inlet and outlet ports and refrigerant flow passages.

2. Description of the Prior Art

In a hermetically sealed compressor, it is advantageous to utilize the refrigerant returning from the evaporator to cool the motor. The transfer of heat from the motor also serves to vaporize any liquid refrigerant present in the input from the evaporator. In this manner the operating efficiency of the motor driven compressor unit is increased.

The piston type compressor also has an inherent noise problem. Suction and discharge pulsations are created in the stream of refrigerant at frequencies in the audio range. These pulsations are conveyed through the compressor structure and hermetically sealed housing to the surrounding air where they produce an unacceptable rise in the ambient noise level. These pulsations have necessitated the addition of muffling devices to the compressor units.

In previous compressor units, the above-mentioned cooling, vaporizing and muffling functions were accomplished by providing cast bases between the motor and compressor. These cast bases were made from iron or similar materials and required extensive machining operations which added to the cost in order to achieve a proper fit between the base and compressor and the base and motor.

U.S. Pat. No. 2,823,850 entitled "Carrier for a Motor Compressor of a Refrigerating Machine" issued to R. Hintze disclosed an alternate construction for the base. A pair of sheet metal members were formed with the proper mounting holes and then soldered together to produce a base. In addition these members were also formed with inlet and outlet ports and dished regions providing passages for conducting refrigerant to and from the compressor. The dished regions also defined accumulator cavities wherein pulsations inherent in a piston type compressor tend to be dampened. However, present day designs and construction methods dictate further reductions in noise levels while decreasing unit size. The present invention utilizes a construction form which provides an efficient muffling function in a relatively small size.

SUMMARY OF THE INVENTION

The present invention concerns improvements in the construction of elements utilized in motor driven refrigeration compressors. In particular, the base between the motor and compressor and the compressor cylinder head are formed from a plurality of planar laminations which contain apertures defining inlet and outlet ports and refrigerant flow passages. The laminated construction reduces the cost of manufacture by eliminating many of the machining operations required for cast bases. At the same time, more intricate passage configurations can be constructed which have optimum noise reducing characteristics.

The laminated base contains integral low-pressure and high-pressure gas circuits. The low-pressure gas circuit directs refrigerant around and through the motor to increase cooling of the motor and high-pressure refrigerant and eliminate liquid entrained in the low-pressure refrigerant. The low-pressure circuit also muffles the noise created by the intake strokes of the compressor. The high-pressure gas circuit is contained in the base walls so as to transfer heat to the incoming low-pressure gas. A series of muffler passages reduce the noise generated by the exhaust strokes of the compressor.

A feature of the invention resides in integral fluid conduits between stacked planar laminations of a form determined by apertures in the laminations. For example, a conduit is provided between two outer laminations by a lamination intermediate those outer laminations having an opening which communicates with inlet and exhaust ports one or both of which can be one or both outer lamination planar faces or can be in an edge of the inner lamination. The shape of the conduit and thus its effect on the fluid can be determined in the plane of the laminations by the shape of the opening in that plane while its shape through the thickness of the stack of laminations is determined by the relationship and shape of the openings in superposed laminations.

Another feature involves the production of compressor parts containing cavities of relatively unlimited form by stamping, stacking and sealingly bonding laminations whereby production of such parts is simplified.

An object of the invention is to improve motor-compressor design and construction.

Another object is to reduce the manufacturing operations required in motor-compressor construction.

A third object of the invention is to increase efficiency of motor-compressors while maintaining low operating noise.

BRIEF DESCRIPTION OF THE DRAWINGS

Other objects and advantages of the present invention will become readily apparent to those skilled in the art from reading the following detailed description of an embodiment of the invention when considered in the light of the accompanying drawings, in which.

DESCRIPTION OF THE PREFERRED EMBODIMENT

The present invention relates to a base utilized between a motor and compressor and a compressor cylinder head of laminated construction in a hermetically sealed compressor unit of the type used in refigeration systems. Basically there are three major problems associated with hermetically sealed compressor units of the reciprocating piston type. The first problem is adequate cooling of the motor since it is totally enclosed in the compressor unit housing. The present invention includes a base of laminated construction which is bell shaped. The motor is mounted at the open end of the bell with the rotor shaft extending through the closed end. The rotor shaft is attached to the crankshaft of a piston type compressor mounted on the exterior side of the closed end of the base. The closed end contains a pair of internal inlet passages which are in communication with the compressor cylinder head. These passages also have an array of inlet ports on the interior face of the closed end of the base. The intake strokes of the compressor create a partial vacuum in the inlet passages whereby vaporized refrigerant is drawn through the base and into the compressor. By placing the inlet tube which supplys the low-pressure refrigerant ambient within the sealed motor-compressor casing from the evaporator at the opposite end of the motor from the base inlet ports the refrigerant is drawn down between the stator and rotor thereby cooling the motor and increasing its efficiency. By appropriately spacing the inlet ports the refrigerant may be directed past known hot spots to balance the operating temperature of the motor. The laminated construction also allows the use of bypass paths in the base walls whereby refrigerant is directed past the exterior of the stator, through the bypass paths and into the inlet openings. This technique equalizes the temperature between the several portions of the motor.

The second problem is caused by liquid refrigerant in the compressor. This liquid refrigerant is relatively incompressible and if a sufficient amount collects in the compressor cylinder, the valves in the valve assembly between the cylinder block and the cylinder head will be damaged during the piston upstroke. This problem is partially solved by heat transfer when the refrigerant is drawn through and around the motor. However, some gas might condense on the walls of the base before it enters the inlet ports. To prevent any condensation, the walls of the base contain the passages for conveying the hotter high-pressure gas from the compressor to the outlet tube which is connected to the condenser. When the low-pressure gas is compressed to a high-pressue gas there is a rise in gas temperature. Some of this heat is transmitted through the relatively thin walls of the base to the incoming refrigerant which is of a lower temperature.

Figure 1:
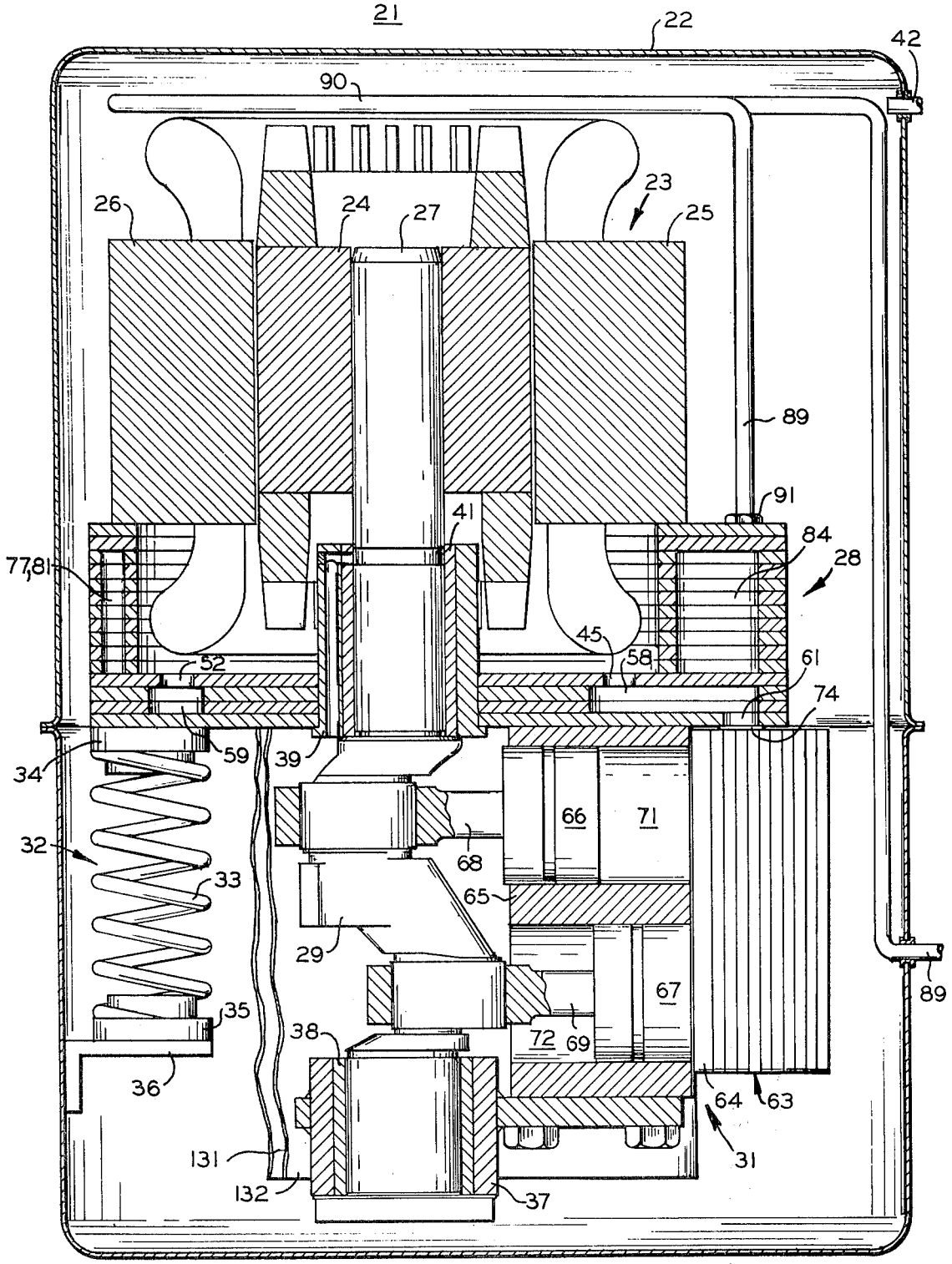
FIG. 1 is a partially sectioned view of a hermetically sealed compressor unit of the type utilized in refrigeration systems with portions broken away.

The third problem encountered in piston type compressor units is that of the noise level. Undesirable noise is generated by both the intake and exhaust strokes of the compressor pistons. Each intake stroke creates a partial vacuum which causes a quantity of refrigerant to be drawn into the compressor through the base. Each exhaust stroke increases the pressure on the outlet circuit by discharging a quantity of high-pressure gas. If the compressor utilizes two pistons, as illustrated in FIG. 1, there will be one intake and one exhaust every one-half revolution of the crankshaft. These periodic intake and exhaust strokes cause corresponding pressure changes on the input line from the evaporator and the output line to the condenser. If a two pole electric motor energized by sixty cycle power is utilized to drive the compressor, the theoretical crankshaft speed would be 3600 revolutions per minute. However, loading and slip cause the actual speed to be approximately 3425 revolutions per minute. Therefore, a two piston compressor driven by a two pole electric motor will produce approximately 6850 pulsations per minute if the pistons are 180° out of phase. This is approximately 114 hertz which is within the lower audio range. These pulses are transmitted through the inlet and outlet tubes and compressor unit housing to the surrounding air where they produce an unacceptable noise level.

The laminated construction of the base provides the opportunity to utilize the optimum configuration for integral muffler passages in both the inlet and outlet circuits. The inlet circuit utilizes a plurality of inlet ports feeding a pair of inlet passages which serve as accumulators. The rotary motion of the motor rotor serves to smooth out the intake pulsations so that the accumulators are sufficient to provide the required decrease in noise level. However, the output circuit requires a series of muffler passages which are positioned in the wall of the base. The laminated base permits the construction of highly efficient muffler passages with baffles which also serve to transfer heat to the incoming refrigerant to eliminate any entrained liquid refrigerant. The operation of these intergral mufflers is such that no external mufflers are required to achieve superior noise reduction.

Referring to FIG. 1, there is shown the preferred embodiment of the present invention as utilized in hermetically sealed compressor unit 21. The sectional view of compressor unit 21 is illustrative of a two piston compressor driven by a two pole electric motor totally enclosed and hermetically sealed by a two piece housing 22. Electric motor 23 has a rotor element 24 and a stator with poles 25 and 26 and is of a type known as an induction motor. Electric motor 23 operates an alternating current and may be started by utilizing a capacitor or an auxiliary winding.

The shaft 27 of rotor 24 extends down through base 28 and is connected to crankshaft 29 of compressor 31. Motor 23 is mounted at the open end of the cavity in base 28 while compressor 31 is mounted at the closed end of base 28. The motor-compressor-base combination is attached to the housing 22 by spring means at several points. Spring mount 32 is typical of such spring means. Spring 33 has its upper end attached to retainer 34 which is attached to base 28. The lower end of spring 33 is attached to retainer 35 which is mounted on bracket 36. Bracket 36 is attached to the wall of housing 22. Vibrations caused by the operation of the motor 23 and compressor 31 are absorbed by the spring 33 to minimize transmission to housing 22 so that compressor unit 21 is relatively vibration free.

Rotor 24 and crankshaft 29 are supported by lower bearing assembly 37 which is attached to compressor 31. The lower end of crankshaft 29 rotates in sleeve bearing 38 while it is supported by the enclosed end of assembly 37. Upper bearing assembly 39 is attached to base 28 and retains rotor shaft 27 which rotates in sleeve bearing 41.

Vaporized refrigerant from the evaporator enters the compressor unit near the top of the housing. Intake strokes of the compressor pistons create a series of partial vacuums which draws the refrigerant down between the stator and rotor of the motor and into inlet ports in the closed end of the base. The refrigerant flows into the inlet ports and through inlet passages in the base to the cylinder head of the compressor. Each downstroke of a compressor piston opens an intake valve (not shown) and the refrigerant is drawn into the cylinder. The intake valve closes on the upstroke and the refrigerant is compressed until there is sufficient pressure to open the exhaust valve (not shown). The exhaust valve allows the high-pressure refrigerant to flow through the cylinder head and into the high-pressure circuit of the base. The base high-pressure circuit is comprised of two accumulators connected by a series of muffler passages the base wall. The high-pressure refrigerant eventually passes out of the compressor unit through an outlet tube connected to a condenser.

Figure 2:
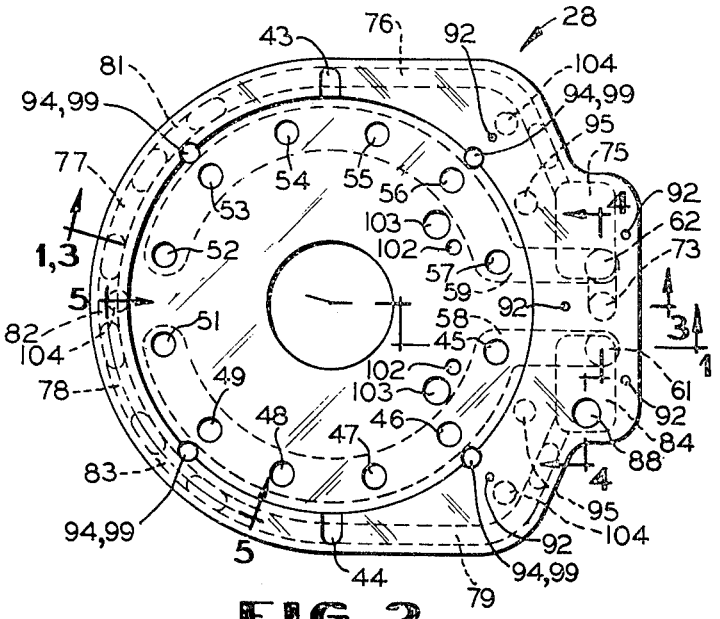
FIG. 2 is a top plan view of the base between the motor and compressor according to the present invention.

Base 28 of FIG. 1 is a sectional view taken along section line 1—1 of FIG. 2. Gaseous refrigerant from the evaporator (now shown) enters the housing 22 through inlet tube 42 so that the interior of the housing is a low-pressure refrigerant environment. The rotational motion of rotor 24 and the partial vacuum created by the compressor draws the refrigerant down between the rotor 24 and stator poles 25 and 26. This flow of refrigerant tends to cool both the rotor and poles thereby increasing the efficiency of the motor 23. Additional cooling may be utilized by providing the rotor 24 with several axially positioned holes near rotor shaft 27. These holes will also increase the amount of refrigerant available to the compressor.

The temperature of the enclosed end of the poles 25 and 26 may be equalized with the free end by providing bypass paths through the wall of base 28. FIG. 2 is a top plan view of base 28 showing bypass paths 43 and 44. These bypass paths are slots in the top lamination of base 28 which extend beyond the exterior of poles 25 and 26. Therefore, refrigerant is drawn down the exterior of poles 25 and 26 through bypass paths 43 and 44 where it joins refrigerant drawn through the interior of the motor 23.

The accumulation of refrigerant between motor 23 and base 28 is directed into base low-pressure inlet ports 45 through 49 and 51 through 57 in base 28. These inlet ports are positioned to direct a separate flow of cooling refrigerant past each of the stator poles 25 and 26. The semi-circle array of inlet ports 45, 46, 47, 48, 49 and 51 is in communication with inlet passage 58 while the semi-circle of inlet ports 52, 53, 54, 55, 56, and 57 is in communication with inlet passages 59. The irregularities of the flow paths for low-pressure refrigerant to the inlet ports 45 to 57 break up the pulses and provide a muffling function. Inlet passages 58 and 59 serve as accumulators whereby the pulsations created by the intake strokes of the pistons are further smoothed. Each intake stroke creates a pressure wave in the low-pressure vapor input circuit which is absorbed by the mass of refrigerant in the inlet passages 58 and 59 thereby reducing the noise level.

The refrigerant is drawn out of inlet passages 58 and 59 through base low-pressure outlet ports 61 and 62 on the exterior surface of the closed end of base 28. The refrigerant then passes into inlet ports on the upper surface of cylinder head 63 of compressor 31. In the particular example a 0.005 inch gap is provided between the base 28 and the cylinder head 63 which allows additional refrigerant to be drawn into the cylinder head from the atmosphere inside housing 22.

Compressor 31 comprises cylinder head 63, valve assembly 64, cylinder block 65, pistons 66 and 67, connecting rods 68 and 69, crankshaft 29 and bearing assemblies 37 and 39. Refrigerant is drawn into the cylinders 71 and 72 on the intake strokes where it is compressed and exhausted into cylinder head 63. This compressed high-pressure gas enters the high-pressure gas circuit of the base and flows into an accumulator. The accumulator is connected to a series of muffler passages which are spaced around the wall of the base. After flowing through the muffler passages the refrigerant enters a second accumulator which is in communication with an outlet tube. Each compression stroke of the pistons creates a pressure wave in the high-pressure vapor circuit which can be a source of the objectionable 114 hertz noise. The two accumulators and the muffler passages absorb the pressure waves and thereby reduce the noise level.

Figure 5:
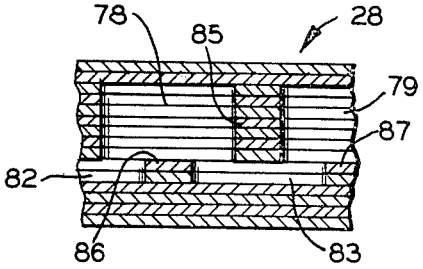
FIG. 5 is a sectional view, taken along line 5—5 of FIG. 2, following the arc of the passages, showing a portion of the passages created in the high-pressure circuit for the refrigerant.
Figure 4:
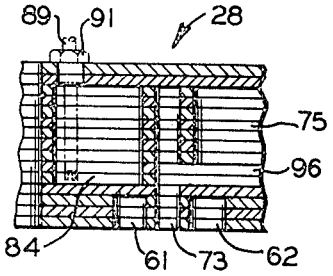
FIG. 4 is a sectional view, taken along line 4—4 of FIG. 2, showing the refrigerant circuit connections between the base and the low-pressure inlets and high-pressure outlet of the compressor and the high-pressure outlet from the base.

The refrigerant exits cylinder head 63 after being compressed and enters base high-pressure inlet port 73 of base 28. O-ring 74 is placed between cylinder head 63 and base 28 to seal these ports and prevent leakage due to the 0.005 inch gap. Inlet port 73 is in communication with accumulator 75 as is shown in FIG. 4, a sectional view taken along section line 4—4 of FIG. 2. FIG. 2 shows that the high-pressure gas circuit is comprised of inlet port 73, accumulator 75, muffler passages 76, 77, 78 and 79, connector passages 81, 82 and 83 and accumulator 84. The muffler passages and connector passages are alternated so as to form baffles in the gas circuit. Referring to FIG. 5, which is a sectional view taken along line 5—5 of FIG. 2, there is shown muffler passage 78 and a portion of muffler passage 79. Passages 78 and 79 are connected together by connector passage 83 so that they are defined as large baffle 85 and two small baffles 86 and 87 in the path of refrigerant flow. The muffler and connector passages form a series of connected anti-resonant cavities whereby the 114 hertz pressure waves are diminished. The thin walls of the passages also facilitate the transfer of heat from the high-pressure gas to evaporate any liquid refrigerant which may be present before the low-pressure gas is drawn into the compressor. The high-pressure gas circuit is terminated by accumulator 84 which with accumulator 75 provides an additional muffling function.

Referring to FIG. 1, 2 and 4 there is shown a base high-pressure outlet port 88 whereby the high-pressure gas is discharged from base 28 and flows through outlet tube 89 to a condenser. A hollow, threaded fitting 91 is screwed into outlet opening 88 and outlet tube 89 is passed through the hole in fitting 91. The end of outlet tube 89 is formed with legs so that it may rest on the bottom of accumulator 84 without preventing the refrigerant from entering the tube. Once in place, outlet tube 89 is hydrogen brazed to fitting 91 to prevent leakage. Outlet tube 89 extends vertically from the base 28 to a point near the top of the housing 22. The tube is bent at a 90° angle and is formed into a horizontal coil 90 of one turn. Next the tube is bent at a 90° angle and extended downward to a point adjacent the cylinder head where another 90° bend is made and the tube exits the housing in a horizontal plane. Outlet tube 89 is formed in such a manner so as to provide a flexible connection to the condenser whereby vibrations from the compressor are absorbed by the tube.

Figure 3:
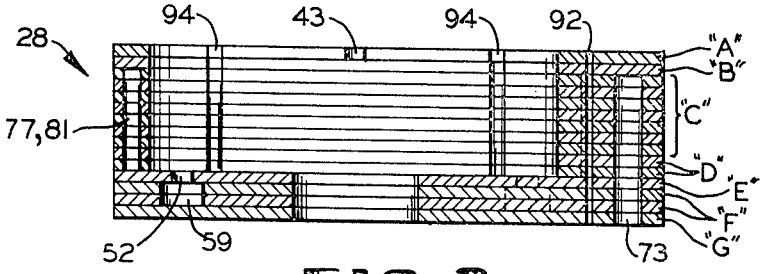
FIG. 3 is a sectional view, taken along line 3—3 of FIG. 2, showing the laminated construction of the base.

FIG. 3 is a sectional view, taken along line 3—3 of FIG. 2, showing the laminated construction of base 28. Base 28 is comprised of a stack of fifteen laminations of seven different types which are hydrogen brazed together. Each lamination is stamped with an array of apertures which form the low-pressure and high-pressure circuits for refrigerant flow. Typically, the stack is formed from one A type lamination, one B type lamination, seven C type laminations, two D type laminations, one E type lamination, two F type laminations and one G type lamination. Each lamination has a set of five alignment holes 92 which may receive rivets or pins for the purpose of holding the laminations in registration while they are sealingly bonded together. Two of the aligment holes, designated as 92' in FIG. 12, in lamination type G are tapped to receive bolts inserted through the stack of laminations in order to further secure the stack.

Figure 6:
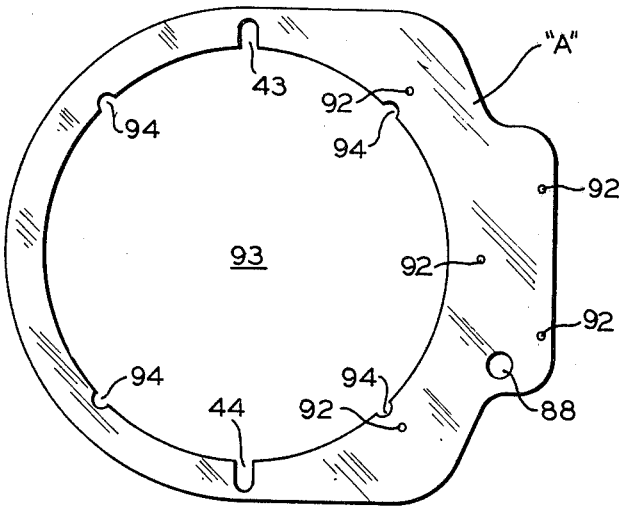
FIG. 6 is a top plan view of a type A lamination showing portions forming the fluid bypass paths and the output port for the compressed refrigerant.

FIG. 6 is a top plan view of a type A lamination showing the fluid bypass paths and the head high-pressure outlet port. One A type lamination is utilized on the top of base 28. Referring to FIGS. 1, 2, 3 and 6 it is shown that stator poles 25 and 26 rest on the upper surface of lamination A. There is a large aperture 93 in the center of the lamination to provide room for the stator windings which extend beyond the poles pieces of the motor, rotor 24 and upper bearing assembly 39. The cavity formed by the large aperture 93 in the A, B, C and D laminations also serves to accumulate refrigerant which is drawn into the base. Bypass paths 43 and 44 extend beyond the exterior surface of poles 25 and 26 to provide auxiliary cooling for the lower enclosed ends of the stator windings. Also shown is base high-pressure outlet port 88 which receives outlet tube 89 and fitting 91. Alignment slots 94 are provided to guide the bolts which attach base 28 to poles 25 and 26.

Figure 7:
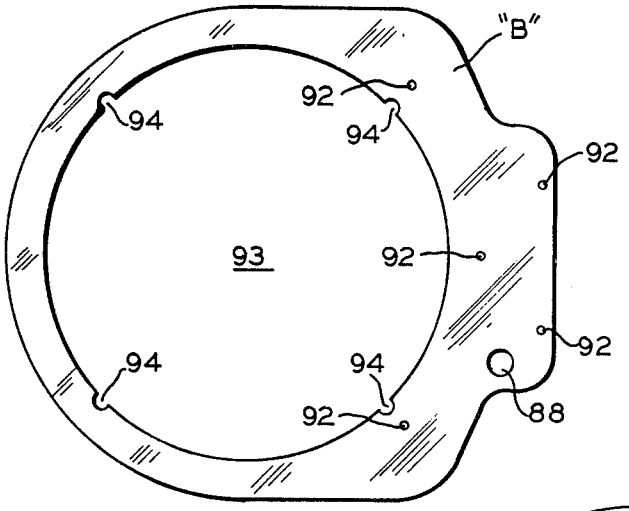
FIG. 7 is a top plan view of a type B lamination.

FIG. 7 is a top plan view of a type B lamination which is the same as the type A lamination of FIG. 6 except that it does not have bypass paths 43 and 44. One type B lamination is utilized under the type A lamination to define the bottom of the bypass slots 43 and 44 and to seal the top of the muffler passages and accumulators. Referring to FIGS. 1, 2, 3, 4, 5 and 7 there is shown a B lamination covering the accumulators 75 and 84, the muffler passages 76, 77, 78 and 79 and the base high-pressure inlet port 73.

Figure 8:
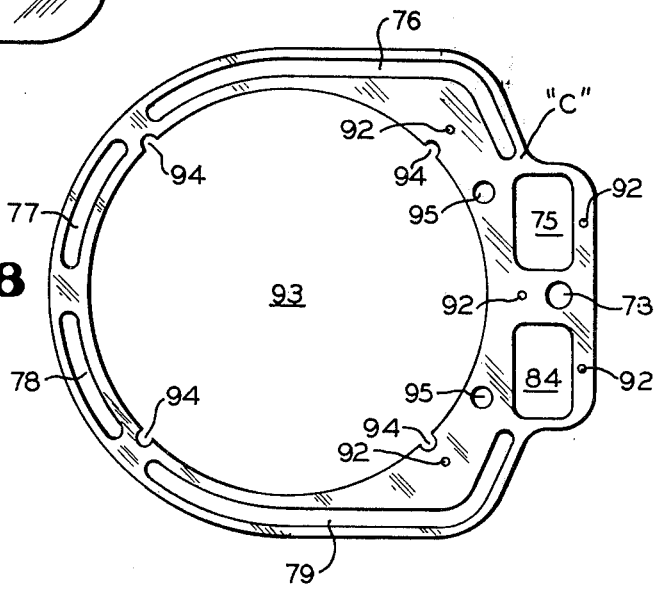
FIG. 8 is a top plan view of a type C lamination showing the apertures forming a portion of the high-pressure refrigerant circuit.

FIG. 8 is a top plan view of a type C lamination which contains apertures for the accumulators, muffler passages and base high-pressure inlet port. Referring to FIGS. 1, 2, 3, 4, 5 and 8 there is shown the use of seven B type laminations to define accumulators 75 and 84, muffler passages 76, 77, 78, and 79 and the upper portion of base high-pressure inlet port 73. The upper portion of inlet port 73 serves as a gas column accumulator to absorb the shock waves from the exhaust pulsations of the compressor before the refrigerant flows into accumulator 75. The C laminations also define the large baffles, such as 85 of FIG. 5, between the muffler passages. Assembly holes 95 receive studs when extend downward into the cylinder block 65 to attach the cylinder block 65 to the base.

Figure 9:
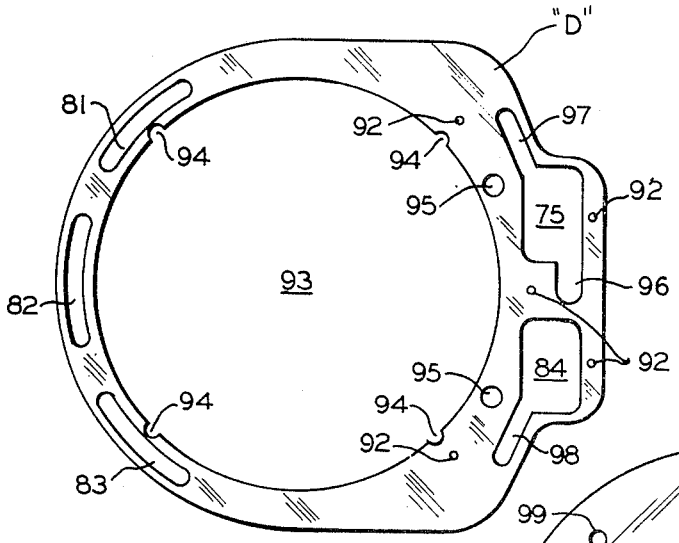
FIG. 9 is a top plan view of a type D lamination showing the remaining portion of the compressed refrigerant circuit.

FIG. 9 is a top plan view of a type D lamination showing the lower portion of the accumulators and the connector passages. Referring to FIGS. 1, 2, 3, 4, 5 and 9 there is shown the utilization of two D type laminations to define the lower portions of accumulators 75 and 84 and the connector passages 81, 82 and 83. The connector passages are in communication with the four muffler passages and define the small baffles such as 86 and 87 of FIG. 5. Accumulator 75 is connected with base high-pressure inlet port 73 by extension 96. Accumulator 75 is connected to muffler passage 76 by extension 97. In a simular manner, accumulator 84 is connected to muffler passage 79 by extension 98. These extensions and connector passages complete the high-pressure gas circuit in the wall of base 28. In summary, the high-pressure gas circuit comprises a high-pressure gas exhaust passage in the cavity walls terminated at either end by an inlet port and an outlet port respectively wherein the passage includes accumulators, muffler passages and connector passages connected in series.

Figure 10:
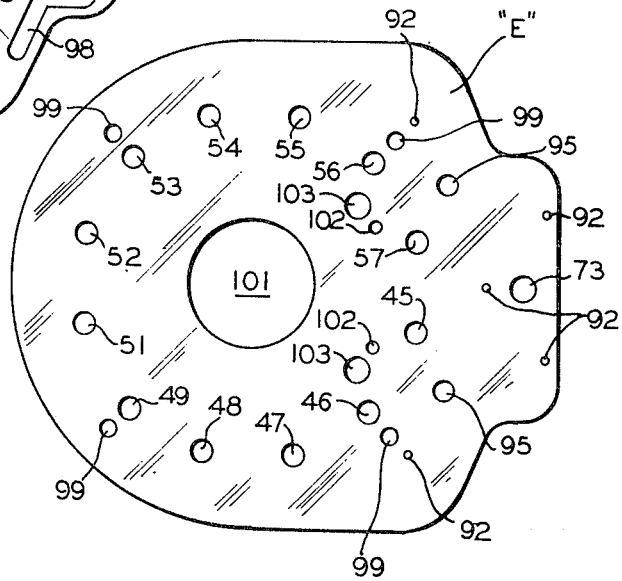
FIG. 10 is a top plan view of a type E lamination showing the inlet ports for low-pressure refrigerant.

FIG. 10 is a top plan view of a type E lamination showing the base low-pressure inlet ports, the bearing assembly opening and defining the bottom of the accumulators and connector passages. Referring to FIGS. 1, 2, 3, 4, 5 and 10 there is shown one E type lamination with base low-pressure inlet ports 45 through 49 and 51 through 57. The E type lamination also provides the bottom for accumulators 75 and 84 and connector passages 81, 82 and 83 in order to seal these cavities. Assembly holes 99 are aligned with alignment slots 94 in the A, B, C and D type laminations and receive bolts which attach base 28 to motor stator poles 25 and 26. These bolts extend upward through the base and are threaded into the stator. The E type lamination also defines the bottom of large aperture 93 in the A through D type laminations. A bearing assembly aperture 101 is provided in which upper bearing assembly 39 is either pressed or brazed. Finally, the E type lamination defines the top of low-pressure outlet ports 61 and 62.

Assembly hols 102 and 103 also are utilized to attach cylinder block 65 to base 28. Assembly holes 102 receive a pair of pins which have one end flush with the upper surface of lamination type E and the other end extending downward into corresponding holes in cylinder block 65. These pins serve to align the base with the cylinder block. Assembly holes 103 receive studs which extend upward through the base 28 from cylinder block 65 and are secured by nuts.

Figure 11:
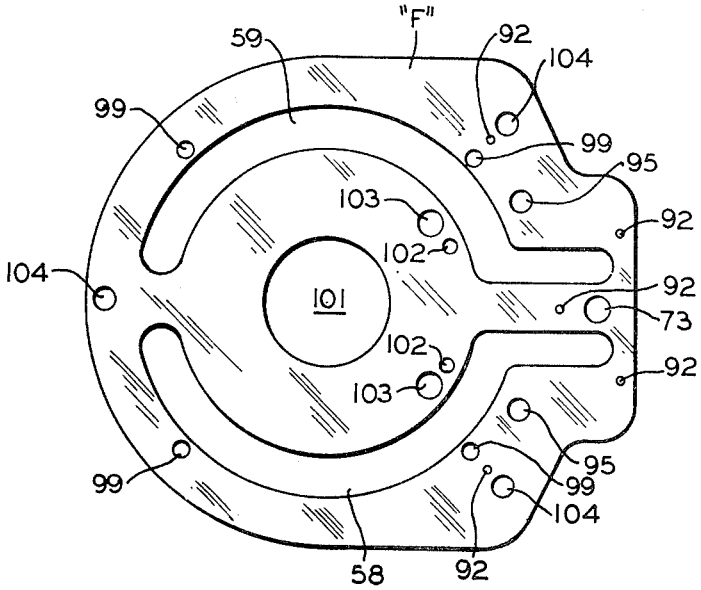
FIG. 11 is a top plan view of a type F lamination showing apertures forming portion of the low-pressure refrigerant circuit.

FIG. 11 is a top plan view of a type F lamination showing the inlet passages of the low-pressure gas circuit. Referring to FIGS. 1, 2, 3, 4, 5 and 11 two F type laminations are utilized to provide inlet passages 58 and 59. Inlet passages are of semi-circular form and are in connection with the base low-pressure inlet ports of the E lamination to provide separate cooling paths for the two poles of motor 23. These passages serve as accumulators to absorb the shock waves caused by the intake pulsations of the compressor. The extensions of inlet passages 58 and 59 serve to form the upper portion of base low-pressure outlet ports 61 and 62. Three spring mounting holes 104 receive spring retainers, such as retainer 34 of FIG. 1, whereby the motor-compressor assembly is attached to housing 22 through spring mounts 32.

Figure 12:
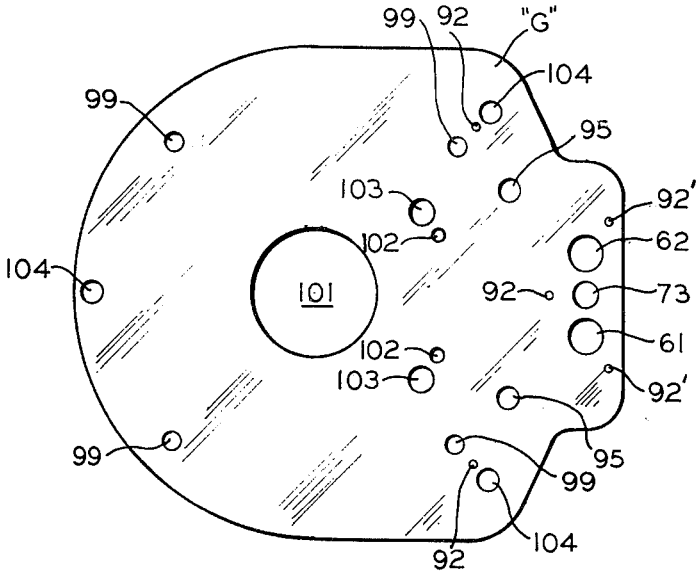
FIG. 12 is a top plan view of a type G lamination showing the inlet and outlet ports which connect the refrigerant circuits of the base with the cylinder head of the compressor.

FIG. 12 is a top plan view of a type G lamination showing the base low-pressure outlet passages and defining the bottom of the inlet passages. Referring to FIGS. 1, 2, 3, 4, 5 and 12 one G type lamination forms the bottom of inlet passages 58 and 59 to seal them. The base low-pressure outlet ports 61 and 62 are in communication with the inlet passages 58 and 59 to complete the base low-pressure gas circuit.

As illustrated in FIGS. 2 and 3 base 28 is constructed from fifteen laminations which form the high-pressure and low-pressure gas circuits and provide the assembly holes whereby motor 23 and compressor 31 are attached to base 28. Base low-pressure inlet ports 45 through 49 and 51 through 57, inlet passages 58 and 59 and base low-pressure outlet ports 61 and 62 comprise the low-pressure gas circuit through which the low-pressure refrigerant is drawn on its way to the compressor. Base high-pressure inlet port 73, accumulators 75 and 84, muffler passages 76 through 79, connector passages 81 through 83 and base high-pressure outlet port 88 define the high-pressure gas circuit through which the high-pressure refrigerant flows on its way to the condenser.

The 15 laminations are stacked together in registration by placing rivets or pins into assembly holes 92. Two of the assembly holes, designated as 92' in FIG. 12, are tapped so that bolts may be inserted from above to further secure the stack. Sealing bonds are formed between the adjacent faces of adjacent laminations. One form of bond is produced by hydrogen brazing wherein the surfaces are fluxed, coated with brazing compounds and passed through a brazing furnace. While brazing will accommodate substantial departures from true flatness, e.g. a gap of 0.005 inch, the surfaces of individual laminations can be ground, after they have been stamped from strip stock, as on a Blanchard grinder to a RMS finish of from 60 microinches to 100 microinches. One exemplary base has been constructed of 8 gauge hot rolled steel ground to 0.147 inch ±.002 inch.

After the laminations of the base assembly have been bonded the upper and lower faces of the base are ground parallel to provide reference surfaces for the motor stator, the crankshaft bearing 39 and the compressor block 65. The block 65 in turn provides reference surfaces for the valve plate 64 and head 63 and for the lower bearing 37.

Alignment slots 94 and assembly holes 99 receive bolts inserted from the bottom of the base 28 which are threaded into stator poles 25 and 26 to secure them to the base. Assembly holes 95, 102, and 103 are utilized to attach cylinder block 65 to base 28. Assembly holes 95 receive studs which are brazed into the base and extend downward into cylinder block 65 which has provision for securing them with nuts. Assembly holes 102 receive a pair of pins which may be a press fit with the base and extend downward into corresponding alignment holes in the cylinder block. Assembly holes 103 receive studs fastened to cylinder block 65 which extend upward through base 28 where they are secured by nuts. In this manner motor 23, base 28 and compressor 31 are assembled together.

Figure 13:
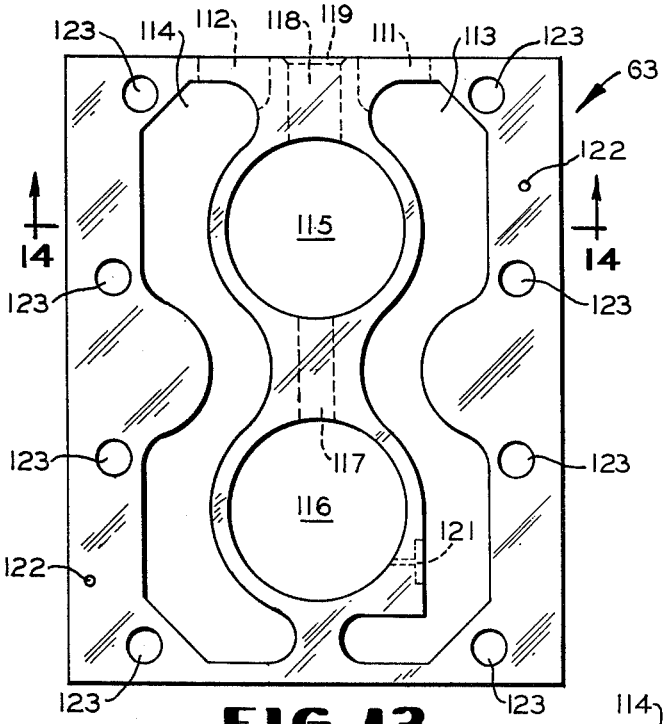
FIG. 13 is a plan view of the compressor clylinder head showing the intake and exhaust manifold passages.

As stated above, the cylinder head 63 has a pair of intake ports adjacent the base low-pressure outlet ports 61 and 62 and an exhaust port adjacent the base high-pressure inlet port 73 which is sealed by O-ring 74. Referring to FIG. 13, there is shown a plan view of the cylinder head revealing the intake and exhaust manifold passages. Low-pressure vapor from the base enters the two intake ports and flows into a pair of intake manifold passages. When an intake valve in the valve assembly is actuated by the partial vacuum created on the downstroke of a piston, the refrigerant flows from both intake manifolds into the cylinder. When the cylinder is full of refrigerant the intake valve closes and the piston beings its upstroke which compresses the refrigerant. Near the top of the piston upstroke the pressure of the compressed gas becomes sufficient to open the exhaust valve and the compressed refrigerant is released into the exhaust manifold. Subsequent exhaust pulses force the refrigerant out the exhaust port and into the base high-pressure inlet port. The valve assembly 64 of FIG. 1 can be any well-known compressor valve structure such as a pair of leaf or disc valves each connecting the intake manifold passages and one of the exhaust manifold passages with one of the cylinders. Typical valve constructions are disclosed in U.S. Pat. No. 3,509,907 issued to E. L. Gannaway and U.S. Pat. No. 3,643,687 issued to S. J. Hudson, Jr.

FIG. 13 is a plan view of cylinder head 63 showing the intake and exhaust manifold passages on the side adjacent the valve assembly in FIG. 1. Intake ports 111 and 112 are adjacent the base low-pressure outlet ports 61 and 62 of base 28. The 0.005 gap between the base 28 and the cylinder head 63 allows additional refrigerant to be drawn into the intake manifold passages 113 and 114 along with the refrigerant from the low-pressure gas circuit of base 28. High-pressure gas from cylinder 71 of FIG. 1 is exhausted into exhaust manifold passage 115 while cylinder 72 exhausts into exhaust manifold passage 116. The manifold passages 115 and 116 are in communication through manifold connector passage 117. The high-pressure gas is exhausted from the cylinder head through exhaust pot 118 which is provided with a chamfer 119. O-ring 74 seats in chamfer 119 and seals port 118 to base high-pressure inlet port 73.

Referring to FIGS. 1, 2 and 13, if piston 66 is completing a downstroke, low-pressure refrigerant is being drawn into cylinder 71. Refrigerant flows from base low-pressure outlet ports 61 and 62 into intake ports 111 and 112 of cylinder head 63. The refrigerant passes into intake manifold passages 113 and 114 and through the open intake valve assembly 64 associated with cylinder 71. At the same time piston 67 is completing an upstroke and the pressure from the compressed refrigerant has opened the exhaust valve in the valve assembly associated with cylinder 72. The compressed refrigerant is exhausted into exhaust manifold passages 116 and displaces refrigerant into and through manifold connector passage 117. Refrigerant which is displaced from exhaust manifold passage 115 exits the cylinder head through exhaust port 118 into base high-pressure inlet port 73.

During the next one half revolution of the crankshaft, piston 67 completes a downstroke which draws low-pressure refrigerant from intake manifold passage 113 and 114 into cylinder 72. Concurrently, piston 66 completes an upstroke which exhausts high-pressure refrigerant into exhaust manifold passage 115. The refrigerant that is displaced from passage 115 exits the cylinder head through exhaust port 118 into base high-pressure inlet port 73.

Base 28 has been designed to eliminate liquid from the low-pressure vapor entering the compressor 31. If sufficient liquid should enter a cylinder however, a relief valve 121 will vent it to intake manifold passage 113. Relief valve 121 is calibrated to vent at a predetermined pressure level in order to protect the high-pressure gas circuit to the condenser. A high-pressure condition in exhaust manifold passage 115 will be transmitted to exhaust manifold passage 116 through manifold connector passage 117 and will be vented through relief valve 121 to intake manifold passage 113. Exhaust manifold passage 116 is vented directly by relief valve 121.

Figure 14:
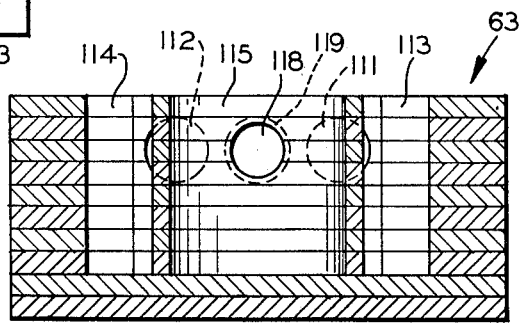
FIG. 14 is a sectional view, taken along the line 14—14 of FIG. 13, showing a cylinder head of laminated construction including manifold passages and intake and exhaust ports.

FIG. 14 is a sectional view, taken along the line 14—14 of FIG. 13, showing the configuration of the intake and exhaust manifold passages. Cylinder head 63 is also constructed of planar laminations and in the present invention is of such dimensions as to be economically formed from the material removed from lamination types A through D to create aperture 93. Passages 113, 114, 115 and 116 may be formed in the individual laminations which then would be stacked and held in registration by pins in alignment holes 122 of FIG. 13. The laminations are then sealingly bonded together as by hydrogen brazing them together in fluid tight relationship after which ports 111, 112 and 118 and connector passage 117 are added. The side of cylinder head 63 facing valve assembly 64 must remain open to be in communication with the intake and exhaust valves while the opposing side is sealed. Assembly holes 123 correspond with similar assembly holes in valve assembly 64. Mounting bolts are passed through holes 123 and are threaded into clyinder block 65 to secure cylinder head 63 and valve assembly 64 to the cylinder block.

In order to further reduce the noise level of compressor unit 21, a sound shield may be formed around the crankshaft to absorb noise generated by the compressor 31. Referring to FIG. 1, there is shown a sound shield 131 formed in a semi-circle following the exterior wall of base 28. Shield 131 partially encloses the crankshaft 29 and cylinder block 65 leaving open only the area around lower bearing assembly 37. The interior wall of shield 131 is covered by insulation 132 which may be a sheet of Nomex 410 high temperature insulating paper manufactured by E. I. DuPont de Nemours & Co., Inc. Insulation 132 absorbs the noise generated by the reciprocating pistons 66 and 67 and radiated from the crankshaft side of cylinder block 65. Shield 131 and the sound absorbing passages of base 28 combine to produce a compressor unit with a relatively low noise level.

From the above, it is evident that the invention may be practiced otherwise than as specifically illustrated and described. Accordingly, it is to be understood that the above disclosure is to be read as illustrative of the invention and not in a limiting sense.

What I claim is:

1. In an integral motor and compressor comprising a base suporting a motor stator, a motor rotor, a compressor head, a valve assembly, a compressor block and a compressor crankshaft the improvement which comprises:

said base being constructed from at least three planar laminations in stacked, face-to-face relation;

a first of said laminations having an aperture formed therein the margins of which define a side wall of a cavity in said base for accommodating one end of said stator windings and rotor;

a second and a third of said laminations comprising an end wall for said cavity;

a low-pressure gas inlet passage integral with the end wall of said cavity and in circumferential alignment with said stator and rotor;

an array of low-pressure gas inlet ports through the end wall of said cavity and in communication with said inlet passage;

a low-pressure outlet port in communication with said inlet passage and through the end wall of said base abutting said compressor head; and an intake manifold passage in said compressor head connected between said valve assembly and said low-pressure gas outlet port.

2. An integral motor and compressor according to claim 1 wherein said laminations are normal to the rotational axis of said motor rotor.

3. An integral motor and compressor according to claim 2 wherein said motor stator is mounted in abutting relation to said base and said base lamination abutting said motor stator contains a low-pressure gas bypass path between said base and said stator through the side wall of said cavity.

4. An integral motor and compressor according to claim 3 wherein said base lamination abutting said motor stator contains at least one low-pressure gas bypass path through the side wall of said cavity adjacent each pole of said stator.

5. An integral motor and compressor according to claim 1 wherein said first lamination cavity is an aperture extendng through the thickness of said lamination; wherein said second lamination is in face-to-face relation with said first lamination; wherein said third lamination has an arcuate aperture the margins of which define walls of said low-pressure gas inlet passage, said third lamination being in face-to-face relation with said second lamination on the face of said second lamination opposite said first lamination; said array of low-pressure gas inlet ports being apertures extending through the thickness of said second lamination in registry with the arcuate aperture in said third lamination; and a fourth lamination in face-to-face relation with said third lamination on the face of said third lamination opposite said second lamination; means maintaining said second, third and fourth laminations in fluid tight relationship along the edges of said arcuate aperture whereby the faces of said laminations in registry with said aperture and the margins of said aperture form fluid tight walls for said low-pressure gas inlet passage.

6. An integral motor and compressor according to claim 5 wherein said means maintaining said second, third and fourth laminations in fluid tight relationship is a bond extending over the abutting, face-to-face surfaces of said laminations.

7. A combination according to claim 1 including a fluid tight seal across the mating faces of laminations stacked in face-to-face relation.

8. A combination according to claim 7 wherein said fluid tight seal is fused bond between said mating faces over their mating surfaces.

9. In an integral motor and compressor comprising a base supporting a motor stator, a motor rotor, a compressor head, a valve assembly, a compressor block and a compressor crankshaft the improvement which comprises:

said base being constructed from at least three planar laminations in stacked, face-to-face relation;

said base having an open-ended cavity for accommodating one end of said stator windings and rotor;

a first and a second of said laminations comprising the side walls of said cavity; a third of said laminations comprising an end wall for said cavity;

said base having a high pressure gas exhaust passage integral with the side wall of said cavity and coaxial with said stator and rotor;

said base having a high-pressure gas inlet port in communication with said exhaust passage; and said base having a high-pressure gas outlet port in communication with said exhaust passage and through a wall of said base.

10. An integral motor and compressor according to claim 9 wherein said second lamination has a first aperture the margins of which forms walls of a first chamber therein, said first chamber being in communication with said exhaust passage and intermediate said inlet port and said exhaust passage said compressor head being mounted adjacent said base and having an exhaust manifold in communication with said inlet port; said second lamination has a second aperture the margins of which forms walls of a second chamber therein, said second chamber being intermediate and in communication with said exhaust passage and said outlet port; and sealing means between said base inlet port and said compressor head exhaust manifold.

11. An integral motor and compressor according to claim 10 wherein said sealing means is an O-ring.

12. An integral motor and compressor according to claim 9 wherein said first lamination has an aperture in the plane thereof, the margins of which define side walls of said cavity having a thickness in the plane of the lamination; and wherein said second lamination is in face-to-face relation with said first lamintation and has an arcuate aperture in registry with the side walls of said cavity defined in said first lamination, the margins of said arcuate aperture defining said high pressure gas exhaust passage.

13. An integral motor and compressor according to claim 9 including a fourth of said laminations comprising an end wall for said cavity; and wherein:

said fourth lamination is intermediate said second and third laminations and in face-to-face relationship therewith;

said base has first and second low-pressure gas inlet passages integral with the end wall of said cavity and in circumferential alignment with said stator and rotor;

said fourth lamination has a first array of apertures through its thickness to provide a first array of low-pressure gas inlet ports through the end wall of said cavity and in communication with said first inlet passage;

said fourth lamination has a second array of apertures through its thickness to provide a second array of low-pressure gas inlet ports through the end of said cavity and in communication with said second inlet passage;

said base has a first low-pressure outlet port in communication with said first inlet passage and through the wall of said base adjacent said compressor head;

said base has a second low-pressure outlet opening in communication with said second inlet passage and through the wall of said base adjacent said compressor head;

said compressor head has a first intake manifold passage connected between said valve assembly and said first low-pressure gas outlet port; and said compressor head has a second intake manifold passage connected between said valve assembly and said second low pressure gas outlet port.

14. An integral motor and compressor according to claim 13 wherein said exhaust passage includes at least one muffler passages having noise reducing characteristics.

15. An integral motor and compressor according to claim 13 wherein said exhaust passage includes a plurality of muffler passage having noise reducing characteristics and being in series communication with one another.

16. An integral motor and compressor according to claim 13 wherein said base is constructed from a plurality of stacked, face-to-face planar laminations, the major surfaces of said laminations being normal to the rotational axis of said rotor; a first group of said laminations including at least said first and second laminations defining the side walls of said cavity; a second group of said laminations including said third and fourth laminations defining the end wall of said cavity having a region of generally circular form in their major surfaces; at least one lamination of said second group having apertures coaxial with said circular region which are annular sectors and are generally concentric with said circular region, the walls of said apertures defining portions of said first and second low-pressure inlet passages; at least said fourth lamination of said second group intermediate said one lamination and said cavity, said fourth lamination forming said end wall of said cavity and having arrays of apertures which register with said annular apertures in said one lamination and define said first and second inlet port arrays; at least said third lamination of said second group juxtaposed said one lamination on the side opposite said fourth lamination to define a portion of the walls of said low pressure passages in the areas in registry with said annular apertures; and means sealingly bonding said laminations in stacked face-to-face relationship.

17. An integral motor and compressor according to claim 13 wherein said base is constructed from a plurality of stacked, face-to-face planar laminations, the major surfaces of said laminations being normal to the rotational axis of said rotor; a first group of said laminations including said first and second laminations defining the side walls of said cavity having a region of generally annular form in their major surfaces and at least some laminations of said first group having apertures in the annular region in their major surfaces which are annular sectors generally concentric with the annular region, the walls of said apertures defining portions of said high pressure passage; said first group of laminations being stacked in face-to-face relationship with at least portions of said apertures of adjacent laminations overlapping each other; a second group of said laminations including said third and fourth laminations stacked with said first group and defining the end wall of said cavity, said second group of said laminations having a region of generally circular form in their major surfaces; at least one lamination of said second group having apertures coaxial with said circular region which are annular sectors and are generally concentric with said circular region, the walls of said apertures defining portions of said first and second low-pressure inlet passages; at least said fourth lamination of said second group intermediate said one lamination and said cavity, said fourth lamination forming said end wall of said cavity and having arrays of apertures which register with said annular apertures in said one lamination and define said first and second inlet port arrays; at least said third lamination of said second group juxtaposed said one lamination on the side opposite said fourth lamination to define a portion of the walls of said low pressure passages in the areas in registry with said annular apertures; and means sealingly bonding said laminations in stacked face-to-face relationship.

18. An integral motor and compressor according to claim 9 wherein said first lamination has an aperture in the plane thereof, the margins of which define side walls of said cavity having a thickness in the plane of the lamination; said second lamination has a plurality of arcuate apertures in registry with the side walls of said cavity defined in said first lamination, the margins of said arcuate apertures defining said high pressure gas exhaust passage and portions of muffler passages having noise reducing characteristics; a lamination in face-to-face relation to said second lamination having cavities in registry with the side walls of said cavity and with portions of said arcuate apertures to provide series communication between arcuate apertures in said high pressure gas exhaust passage.

19. An integral motor and compressor according to claim 13 including a sound shield coaxial with said compressor crankshaft.

20. An integral motor and compressor according to claim 19 wherein said sound shield includes sound absorbing insulation.

21. An integral motor and compressor according to claim 9 wherein said base is constructed from a plurality of stacked, face-to-face planar laminations, the major surfaces of said laminations being normal to the rotational axis of said rotor; a first group of said laminations including said first and second laminations defining the side walls of said cavity having a region of generally annular form in their major surfaces and at least some laminations of said first group having apertures in the annular region in their major surfaces which are annular sectors generally concentric with the annular region, the walls of said apertures defining portions of said high pressure passage; and means sealingly bonding said laminations in stacked, face-to-face relationship with at least portions of said apertures of adjacent laminations overlapping each other.

22. An integral motor and compressor according to claim 21 wherein at least two of said annular laminations in face-to-face relationship have their annular sector apertures offset circumferentially with respect to each other.

23. A base supporting a motor stator, a motor rotor and a compressor head, said base comprising:

first and second planar laminations;

at least third and fourth planar laminations intermediate said first and second laminations;

one of said first and second planar laminations and at least one intermediate lamination contiguous with said one planar lamination having registering apertures adapted to form a cavity for accommodating one end of the stator windings and the motor rotor;

at least one of said intermediate laminations having an aperture forming with said laminations contiguous therewith, a low pressure gas inlet passage;

a lamination defining a wall of said low pressure gas inlet passage having an aperture forming a low pressure gas inlet port in communication with said cavity and with said inlet passage;

a lamination defining a wall of said low pressure gas inlet passage having an aperture forming a low pressure gas outlet port in communication with said gas inlet passage and said compressor head; and means securing said laminations together in a fluid tight, stacked, face-to-face relationship to each other whereby the edges of said aperture forming said low pressure gas inlet passage are sealingly engaged with overlying laminations.

24. A base supporting a motor stator, a motor rotor and a compressor head, said base comprising:

first and second planar laminations;

at least one intermediate planar lamination between said first and second laminations;

two contiguous laminations having registering apertures adapted to form a cavity for accommodating one end of said stator windings and said motor rotor;

said intermediate lamination having an aperture integral with that portion of the side wall of said cavity and forming with said laminations contiguous therewith a high pressure gas exhaust passage;

a lamination defining a wall of said high pressure gas exhaust passage having an aperture in communication with the compressor head and said high pressure exhaust passage to form a high pressure gas inlet port into said exhaust passage;

a lamination defining a wall of said high pressure gas exhaust passage having an aperture in communication with said high pressure exhaust passage and extending through the wall of said base to form a high pressure gas outlet port; and means securing said laminations together in a fluid tight, stacked, face-to-face relationship to each other whereby the edges of said aperture forming said high pressure gas exhaust passage are sealingly engaged with overlying laminations.

* * * * *